US009144982B2

(12) United States Patent
Miyamoto et al.

(10) Patent No.: US 9,144,982 B2
(45) Date of Patent: Sep. 29, 2015

(54) LIQUID EJECTING APPARATUS

(71) Applicant: SEIKO EPSON CORPORATION, Tokyo (JP)

(72) Inventors: Masaaki Miyamoto, Shiojiri (JP); Kazuyuki Fujioka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/134,563

(22) Filed: Dec. 19, 2013

(65) Prior Publication Data

US 2014/0184690 A1 Jul. 3, 2014

(30) Foreign Application Priority Data

Dec. 27, 2012 (JP) ..... 2012-284497
Mar. 4, 2013 (JP) ..... 2013-041913

(51) Int. Cl.
*B41J 2/165* (2006.01)
*B41J 2/17* (2006.01)

(52) U.S. Cl.
CPC ..... *B41J 2/1721* (2013.01); *B41J 2/16523* (2013.01); *B41J 2/16526* (2013.01); *B41J 2/16541* (2013.01)

(58) Field of Classification Search
USPC ..... 347/6, 30, 33, 36, 21–23
See application file for complete search history.

(56) References Cited

U.S. PATENT DOCUMENTS

| | | | | |
|---|---|---|---|---|
| 5,896,145 | A | 4/1999 | Osborne et al. | |
| 2007/0273725 | A1 * | 11/2007 | Furukawa et al. | 347/36 |
| 2009/0219337 | A1 * | 9/2009 | Harada et al. | 347/36 |
| 2010/0149231 | A1 * | 6/2010 | Mori et al. | 347/6 |

FOREIGN PATENT DOCUMENTS

| | | | |
|---|---|---|---|
| JP | 07-276657 | | 10/1995 |
| JP | 2001-162836 | | 6/2001 |
| JP | 2008-055837 | | 3/2008 |
| JP | 2011-126062 | | 6/2011 |
| JP | 2011126062 | A * | 6/2011 |
| JP | 2011-156781 | | 8/2011 |
| JP | 2011-161690 | | 8/2011 |
| JP | 2012-051138 | | 3/2012 |

* cited by examiner

*Primary Examiner* — Jason Uhlenhake
(74) *Attorney, Agent, or Firm* — Workman Nydegger

(57) ABSTRACT

A liquid ejecting apparatus includes an ejecting head that can eject a solution; a rotational body that has a circumferential surface which can accommodate the solution ejected from the ejecting head; a scraper that can come into sliding contact with the circumferential surface of the rotational body; and an accommodation container that accommodates the solution which is scraped off from the circumferential surface by the scraper. The accommodation container has a liquid storage section that stores a liquid which can dissolve a solute component of the solution.

5 Claims, 7 Drawing Sheets

LIQUID EJECTING APPARATUS

BACKGROUND

1. Technical Field

The present invention relates to a liquid ejecting apparatus that ejects a liquid such as an ink.

2. Related Art

In the related art, there is an ink jet type printer that ejects a solution (for example, ink) containing a solute component (for example, pigment) on a medium (for example, sheet) to perform printing, as a liquid ejecting apparatus that ejects a liquid.

In such a printer, a technology is known which ejects an ink toward a belt member to suppress the clogging of a nozzle from which the ink is ejected. A scraper scrapes off an ink attached onto the belt member and the scraped ink is accommodated in a waste container (for example, JP-A-2011-161690).

There is a problem that, when the waste container accommodates an ink solidified on the belt member or an ink accommodated in the waste container solidifies, the solidified ink is deposited in the waste container, such that the waste container cannot be used in spite of the fact that there is still empty gaps in the waste container.

Such a problem is not limited to a printer that is configured to accommodate an ink attached onto the belt member in the waste container, and the problem is generally common to a liquid ejecting apparatus equipped with an accommodation container that accommodates a solution with a possibility of the solute component solidifying.

SUMMARY

An advantage of some aspects of the invention is to provide a liquid ejecting apparatus that can suppress the occurrence of deposits which are caused by solidification of a solution.

Hereinafter, means and operation effects thereof will be described.

According to an aspect of the invention, a liquid ejecting apparatus includes: an ejecting head that can eject a solution; a rotational body that has a circumferential surface which can accommodate the solution ejected from the ejecting head; a scraper that can come into sliding contact with the circumferential surface of the rotational body; and an accommodation container that accommodates the solution which is scraped off from the circumferential surface by the scraper. The accommodation container has a liquid storage section that stores a liquid which can dissolve a solute component of the solution.

In this configuration, the solution attached onto the circumferential surface of the rotational body is scraped off by the scraper and is accommodated in the accommodation container. When the solution which is scraped off by the scraper solidifies, the solidified solute component can be redissolved in the liquid stored in the liquid storage section. Accordingly, the occurrence of deposits in the accommodation container, which are caused by the solidification of the solution, can be suppressed.

The liquid ejecting apparatus may further include a waste liquid recovery passage that recovers a waste liquid. The accommodation container may have a liquid outlet at a position which is located above the waste liquid recovery passage in a direction of gravity.

In this configuration, the liquid stored in the liquid storage section is drained to the waste liquid recovery passage via the liquid outlet, and thus the service life of the accommodation container can be extended.

In the liquid ejecting apparatus, the accommodation container may have an opening which is open at a position at least below a tip of the scraper in a direction of gravity. The liquid outlet of the accommodation container may be arranged between the opening and the liquid storage section in a direction of gravity.

In this configuration, when the level of the liquid in the liquid storage section reaches the liquid outlet, solidified substances of the solution can be retained in the accommodation container whereas a supernatant of the solution can be drained to the waste liquid recovery passage. For this reason, the solidified substances can be suppressed from being deposited in the waste liquid recovery passage.

The liquid ejecting apparatus may further include a suction mechanism that sucks the solution from the ejecting head; and an introduction passage that introduces the solution, which is sucked by the suction mechanism, into the liquid storage section.

In this configuration, since the solution is sucked from the ejecting head to be introduced to the liquid storage section via the introduction passage, the solidified solute component in the accommodation container can be redissolved in the solution. Accordingly, a liquid for redissolving the solute component is not required to be separately provided.

The liquid ejecting apparatus may further include a retention frame that rotatably retains the rotational body; and a mounting section on which the accommodation container and the retention frame are detachably mounted. The accommodation container may have a retention section that retains the scraper, and when the accommodation container and the retention frame may form an accommodation chamber to surround the scraper when mounted on the mounting section.

In this configuration, when the solidified substances of the solution are accumulated in the accommodation container, the accommodation container can be disconnected from the mounting section for maintenance such as cleaning or replacement. In addition, since the accommodation chamber, which is formed by the accommodation container and the retention frame, has a high solvent concentration due to a solvent component evaporating from the liquid storage section, the solution which is scraped off by the scraper can be suppressed from solidifying.

In the liquid ejecting apparatus, the solution ejected from the ejecting head and the liquid stored in the liquid storage section may contain water.

In this configuration, since the solution ejected from the ejecting head contains water, the solute component of the solidified solution can be redissolved in the accommodation container when the solution, which is scraped off by the scraper, is stored in the liquid storage section together with the liquid containing water.

A liquid ejecting apparatus according to another aspect of the invention includes a liquid ejecting head that ejects a liquid; a liquid receiving section that has a liquid receiving surface which receives the liquid ejected from the liquid ejecting head; a moisturizing liquid supply section that supplies a moisturizing liquid to the liquid receiving surface of the liquid receiving section; and a liquid scraping section that moves relative to the liquid receiving section to scrape off the liquid which is ejected from the liquid ejecting head and is attached onto the liquid receiving surface. The liquid ejecting head ejects the liquid onto a moisturizing area of the liquid receiving surface in the liquid receiving section to which the moisturizing liquid supply section supplies the moisturizing liquid.

In this configuration, since the liquid ejecting head ejects the liquid onto the moisturizing area of the liquid receiving surface in the liquid receiving section to which the moisturizing liquid is supplied, the liquid, which is attached onto the liquid receiving surface of the liquid receiving section, is scraped off by the liquid scraping section in a state where the liquid is suppressed by the moisturizing liquid from drying and solidifying. Accordingly, while the liquid attached onto the liquid receiving section can be suppressed from solidifying on the liquid receiving section, the liquid can be scraped off from the liquid receiving section.

In the liquid ejection apparatus, the moisturizing liquid supply section is preferably detachable.

In this configuration, since the moisturizing liquid supply section is detachable with respect to the liquid ejecting apparatus, the moisturizing liquid can be easily refilled or the moisturizing liquid supply section can be easily replaced. For this reason, the amount of the moisturizing liquid, which is required to be retained by the moisturizing liquid supply section, can be reduced, and thus the apparatus can be suppressed from being increased in size.

In the liquid ejecting apparatus, the liquid receiving section, the moisturizing liquid supply section and the liquid scraping section are preferably detachable in an integral manner.

In this configuration, since a plurality of members are detachable in an integral manner, assemblability can be improved compared to a state where each member is individually assembled. Furthermore, for example, since the moisturizing liquid supply section can be refilled with the moisturizing liquid in a state where the respective members are disassembled in an integral manner, the apparatus can adopt such an arrangement that the moisturizing liquid supply section is hidden behind other members, and it is possible to increase the degree of freedom of the respective members being arranged.

In the liquid ejecting apparatus, it is preferable that the liquid is substantially free of glycerin, but that the moisturizing liquid does contain glycerin.

In this configuration, even though the liquid is substantially free of glycerin and is likely to dry, the liquid attached onto the liquid receiving surface of the liquid receiving section is scraped off by the liquid scraping section in a state where the liquid is suppressed by the glycerin-containing moisturizing liquid from drying and solidifying. Accordingly, it is possible to scrape off the liquid attached onto the liquid receiving section from the liquid receiving section while suppressing the liquid from solidifying on the liquid receiving section.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of a liquid ejecting apparatus that can eject a solution will be described with reference to the accompanying drawings.

For example, the liquid ejecting apparatus is a printer that ejects an ink as an example of the solution onto a sheet as an example of a medium to perform printing.

First Embodiment

Figure 1:
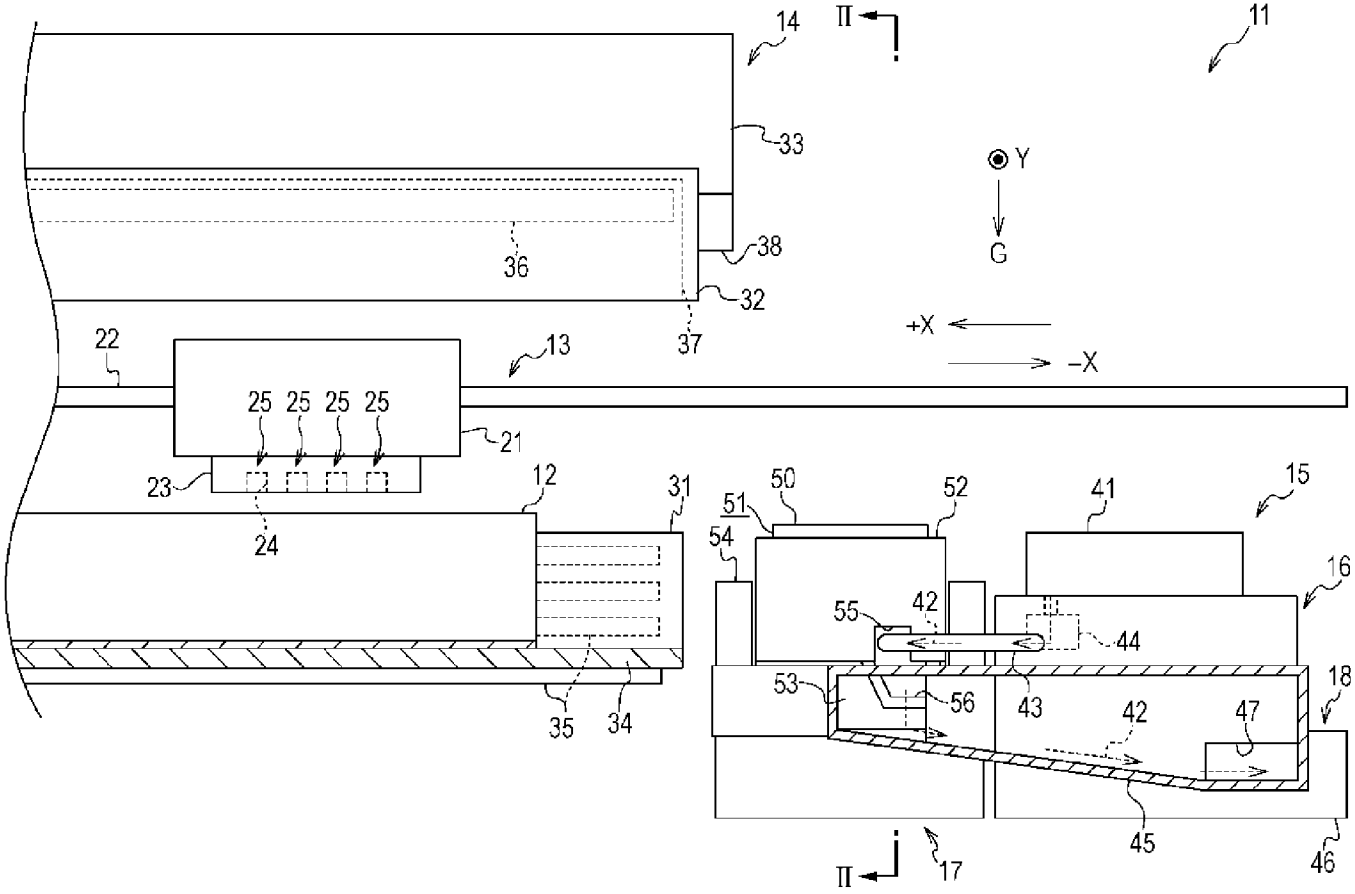
FIG. 1 is a cross-sectional view illustrating an outline configuration of a printer according to embodiments.

As illustrated in FIG. 1, a liquid ejecting apparatus 11 according to the embodiment includes an ejecting section 13 that ejects the solution onto a medium 12; a drying apparatus 14 that dries the medium 12 which accommodates the solution; and a maintenance apparatus 15 that performs the maintenance of the ejecting section 13.

For example, the solution ejected from the ejecting section 13 is a water-based resin ink containing water as a solvent and a resin pigment as a solute. In addition, it is preferable that the solution is substantially free of glycerin with a boiling point of 290° C. under a pressure of 1 atm.

When the solution contains a substantial amount of glycerin, drying properties of the solution are significantly degraded. As a result, the medium 12 that contains the solution does not sufficiently dry, or non-uniformity in the gradation of an image becomes prominent, or fixability of the solute deteriorates. When the medium 12 has a low solution absorbance or hardly has any solution absorbance, such a tendency becomes particularly remarkable. Furthermore, it is preferable that the solution ejected from the ejecting section 13 is substantially free of alkyl polyols (except for the above-described glycerin) with a boiling point of 280° C. or higher under a pressure equivalent to 1 atm.

Herein, a phrase "that the solution is substantially free of alkyl polyols" means that the amount of the alkyl polyols contained in the solution is not equal to or more than a level where the intent of adding the alkyl polyols can be sufficiently demonstrated. Quantitatively, the amount of glycerin is preferably not equal to or more than 1.0 mass % with respect to the total mass of the solution (100 mass %), more preferably not equal to or more than 0.5 mass %, even more preferably not equal to or more than 0.1 mass %, yet even more preferably not equal to or more than 0.05 mass %, particularly preferably not equal to or more than 0.01 mass % and most preferably not equal to or more than 0.001 mass %.

Subsequently, the configuration of the ejecting section 13 will be described.

The ejecting section 13 includes a carriage 21 that can undergo reciprocating movement along a guide shaft 22 extended in a movement direction X (+X, −X); and an ejecting head 23 that can eject the solution.

The carriage 21 takes a first end side (right end side in FIG. 1) as a home position in the movement direction X. The carriage 21 alternately performs an outward movement that the carriage 21 is moved toward +X movement direction from the home position (toward the left direction in FIG. 1) and a homeward movement that the carriage 21 is moved toward −X movement direction (toward the right direction in FIG. 1), and the carriage 21 undergoes reciprocating movement in the movement direction X.

In a movement area of the carriage 21 which is extended in the movement direction X, an area around the center of the movement area except for both end sides in the movement direction X becomes a printing area of which the medium 12 the solution is ejected onto. A transportation mechanism which is not illustrated transports the medium 12 along a transportation direction Y which intersects the movement direction of the carriage 21 and a gravity direction G.

The ejecting head 23 is retained by the carriage 21. The ejecting head 23 has a plurality of nozzles 24 for ejecting the solution. The plurality of nozzles 24 are arranged side by side in the transportation direction Y to form a nozzle row 25. For example, a plurality of the nozzle rows 25 (for example, 4 rows) can be arranged depending on types of the solution such as the color of the solution. When the carriage 21 undergoes reciprocating movement in the movement direction X, the ejecting head 23 ejects the solution through each nozzle row 25 and the medium 12 is overstruck with the solution, thereby performing printing.

Subsequently, the configuration of the drying apparatus 14 will be described.

The drying apparatus 14 is arranged at a position which corresponds to the printing area in the movement direction X. The drying apparatus 14 includes a heating section 31 that is arranged below the carriage 21 in the gravity direction G; and a heat generation section 32 and an air blowing section 33 that are arranged above the carriage 21 in the gravity direction G.

The heating section 31 has a supporting bed 34 which stands the medium 12 on a surface side thereof and a heater 35 that is arranged on a back surface side of the supporting bed 34. For example, the supporting bed 34 is made of a metal plate which is extended in the transportation direction Y and transfers heat of the heater 35 to the medium 12.

The supporting bed 34 is preferably tilted to be lowered from a position, which corresponds to the movement area of the carriage 21, toward an upstream side and a downstream side in the transportation direction Y in such a manner that the medium 12 is free of wrinkles. In the embodiment, the downstream side in the transportation direction Y is referred to as a front side. In addition, FIG. 1 is a cross-sectional view of the liquid ejecting apparatus 11 seen from the front side.

The heater 35 heats the medium 12 from a back surface side thereof to mainly fix the pigment which is the solute of the solution attached onto the medium 12. For this reason, the heater 35 is preferably arranged on the downstream side of the printing area in the transportation direction Y.

The heat generation section 32 includes a heat generation body 36 and a reflective plate 37 that is arranged to cover the heat generation body 36 from above. For example, the heat generation body 36 is an infrared heater, and the heat generation section 32 promotes evaporation of the solvent component (for example, water) contained in the solution attached onto the medium 12 with infrared light radiated from the heat generation body 36 and radiant heat of the infrared light reflected by the reflective plate 37.

The air blowing section 33 includes an air blowing outlet 38 that blows air toward the supporting bed 34. The air blowing section 33 blows air toward the medium 12 on the supporting bed 34 to promote the drying of the medium 12 and diffuses the evaporated solvent component.

Subsequently, the configuration of the maintenance apparatus 15 will be described.

The maintenance apparatus 15 is arranged on a first end side (right end side in FIG. 1) of the movement area of the carriage 21.

The maintenance apparatus 15 includes a suction mechanism 16 that sucks the solution from the ejecting head 23; a flushing section 17 that accommodates the solution ejected from the ejecting head 23; and a waste liquid recovery section 18 that recovers the solution discharged as a waste liquid from the ejecting head 23.

Flushing is defined as an operation in which the ejecting heads 23 ejects the solution toward the flushing section 17 to suppress the clogging of the nozzles 24. In addition, the suction mechanism 16 sucks and discharges the solution from the ejecting head 23 via the nozzles 24, thereby performing the suction cleaning of the ejecting head 23. The solution, which is discharged from the ejecting head 23 for the maintenance of the ejecting head 23 such as a flushing or a suction cleaning, is referred to as the waste liquid.

The suction mechanism 16 includes a bottomed box-shaped cap 41; an introduction passage 43 that forms a waste liquid recovery passage 42 of which an upstream end is open toward a bottom portion of the cap 41; a suction pump 44 that is arranged in the middle of the introduction passage 43. For example, the introduction passage 43 is a flexible tube, and, for example, the suction pump 44 is a tube pump that squeezes the tube in one direction to generate a negative pressure in the cap 41.

When the ejecting head 23 does not eject the liquid, the carriage 21 is stopped at the home position which is set above the suction mechanism 16. When the carriage 21 is arranged at the home position, the cap 41 is moved upward and comes into contact with the ejecting head 23 to surround the nozzles 24. In this way, the ejecting head 23 is capped with the cap 41, and thus the nozzles 24 are suppressed from drying.

In addition, when the suction pump 44 is driven in a state where the ejecting head 23 is capped with the cap 41, the solution is sucked via the nozzles 24 from the ejecting head 23 to be discharged via the introduction passage 43.

The flushing section 17 includes the rotational body 51 that has a circumferential surface 50 which can accommodate the solution ejected from the ejecting head 23; a retention frame 52 that rotatably retains the rotational body 51; an accommodation container 53 that is arranged below the retention frame 52; and a mounting section 54. The accommodation container 53 and the retention frame 52 are detachably mounted on the mounting section 54.

The waste liquid recovery section 18 includes a discharge passage 45 that is arranged to line up with the accommodation container 53 and the suction mechanism 16 in a direction which intersects the gravity direction G (downstream side in the transportation direction Y which is the front side in the embodiment); and a waste liquid tank 46 that is arranged below the suction mechanism 16. The discharge passage 45 forms a portion on the downstream side of the waste liquid recovery passage 42. The discharge passage 45 communicates with the waste liquid tank 46 via a communication hole 47.

A notched portion 55 is formed on a front surface side of the retention frame 52, and a downstream end of the introduction passage 43 is inserted into the notched portion 55. In addition, a liquid outlet 56 is formed on a front surface side of the accommodation container 53 and the liquid outlet 56 is open toward the discharge passage 45 side which is the waste liquid recovery passage 42 side. The liquid outlet 56 is arranged a position which is above the discharge passage 45 in the gravity direction G. The discharge passage 45 is tilted to be lowered toward the communication hole 47 side, which is the downstream side, from the liquid outlet 56 which is on the upstream side.

The accommodation container 53 is provided in the middle of the waste liquid recovery passage 42. For this reason, the waste liquid, which is discharged from the ejecting head 23 by the suction of the suction mechanism 16, is introduced to the accommodation container 53 via the introduction passage 43. In addition, the waste liquid, which is discharged from the accommodation container 53 via the liquid outlet 56, is introduced to the waste liquid tank 46 via the discharge passage 45 and the communication hole 47.

Figure 2:
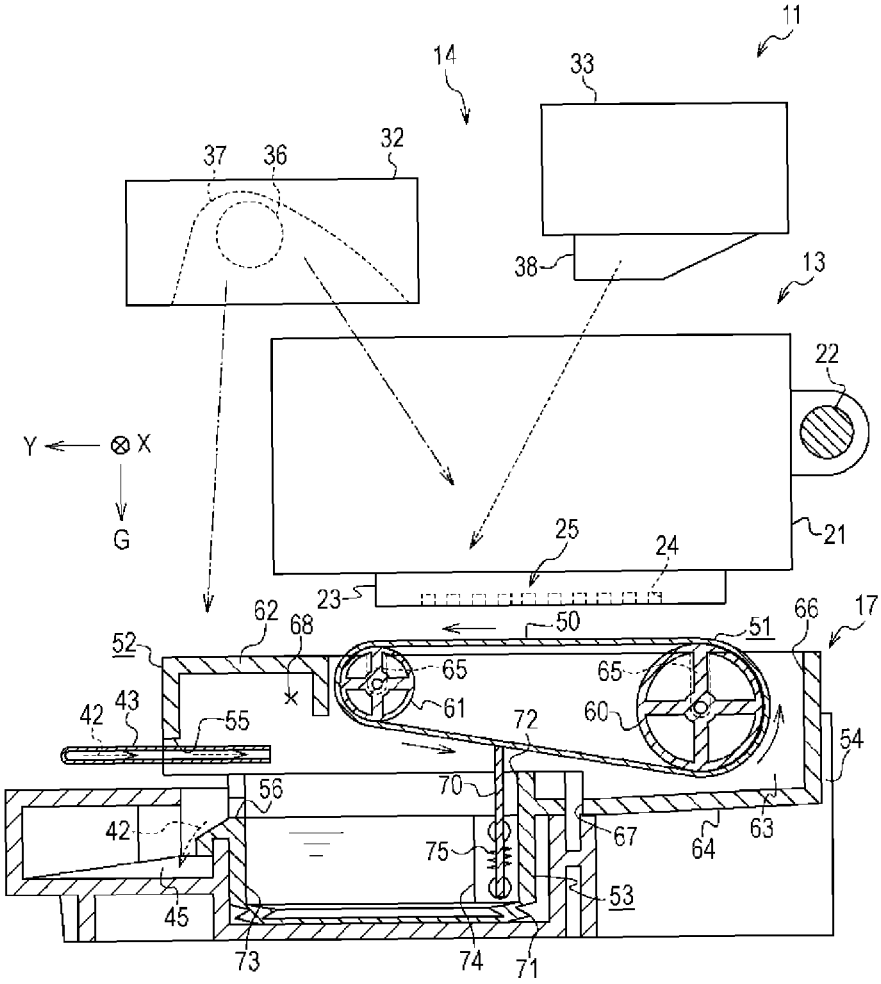
FIG. 2 is a cross-sectional view taken along arrow II-II in FIG. 1.

As illustrated in FIG. 2, for example, the rotational body 51 is an endless belt that is wound around rollers 60 and 61. The roller 60 is a drive roller that is rotated in a counterclockwise direction in FIG. 2 by a driving source which is not illustrated. On the other hand, the roller 61 is a driven roller that is rotated following the rotation of the roller 60 and the rotational body 51. The roller 61 is smaller than the roller 60 in diameter and is arranged on a side in front of the roller 60 (left side in FIG. 2).

The retention frame 52 has the shape of a box with an upper wall 62, a side wall 63 and a bottom wall 64. The retention frame 52 is longer than the accommodation container 53 in length in a direction along the transportation direction Y (left and right direction in FIG. 2).

Bearings 65 are formed in the side wall 63 of the retention frame 52 to rotatably and detachably retain the rollers 60 and 61. In addition, an upper opening 66 for exposing the rotational body 51 to the outside is formed on a rear side (right side in FIG. 2) of the upper wall 62. Furthermore, a lower opening 67 for detachably mounting the accommodation container 53 is formed on a front side (left side in FIG. 2) of the bottom wall 64.

When the accommodation container 53 is mounted on the retention frame 52, the accommodation container 53 enclosedly forms an accommodation chamber 68. In addition, the accommodation chamber 68 accommodates a plate-shaped scraper 70 that can come into sliding contact with the circumferential surface 50 of the rotational body 51 from below. That is, when the accommodation container 53 and the retention frame 52 are mounted on the mounting section 54 as illustrated in FIG. 2, the accommodation container 53 and the retention frame 52 form the accommodation chamber 68 that surrounds the scraper 70.

The accommodation container 53 has the shape of a bottomed box with a bottom portion 71. The bottom portion 71 of the accommodation container 53 has a bellows-like shape and can be expanded and contracted. When the accommodation container 53 is mounted on the mounting section 54, the bottom portion 71 is in a contracted state.

The accommodation container 53 has an opening 72 into which the scraper 70 is inserted and a liquid storage section 73 that is arranged below the opening 72 in the gravity direction G. In addition, the accommodation container 53 has a retention section 74 that retains the scraper 70 at a position which is located on a rear side the accommodation container 53 (right side in FIG. 2).

The retention section 74 has a bias member 75 that biases the scraper 70 upward in the gravity direction G. For example, the bias member 75 is a coil spring. The scraper 70 retained by the retention section 74 is push-pressed to the circumferential surface 50 of the rotational body 51 with a bias force of the bias member 75.

After the ejecting head 23 is flushed, the roller 60 undergoes drive rotation and thus the rotational body 51 is rotated in a direction illustrated by an arrow in FIG. 2. The amount of rotation at this time is preferably on the order of half of the circumferential length of the circumferential surface 50 in such a manner that the circumferential surface 50 comes into sliding contact with the scraper 70 in a portion thereof which accommodates the solution ejected from the ejecting head 23.

The scraper 70 comes into sliding contact with the circumferential surface 50 of the rotational body 51 that is rotated, and thus the scraper 70 scrapes off the solution attached onto the circumferential surface 50 of the rotational body 51. The solution which is scraped off by the scraper 70 falls into the liquid storage section 73 and is accommodated in the accommodation container 53. That is, the accommodation container 53 accommodates the solution which is scraped off from the circumferential surface 50 by the scraper 70.

Herein, the liquid outlet 56 of the accommodation container 53 is arranged between the opening 72 and the liquid storage section 73 in the gravity direction G. In addition, the notched portion 55 of the retention frame 52 and the downstream end of the introduction passage 43, which is inserted into the notched portion 55, are arranged above the liquid outlet 56 in the gravity direction G.

Whenever the solution is sucked from the ejecting head 23, the solution as the waste liquid is introduced to the liquid storage section 73 via the introduction passage 43. In addition, when the liquid level of the solution accumulated in the liquid storage section 73 reaches the liquid outlet 56, a supernatant of the solution is drained to the discharge passage 45 via the liquid outlet 56.

Subsequently, an operation of the liquid ejecting apparatus 11 with the above-described configuration will be described.

In the liquid ejecting apparatus 11, before the solution is ejected, the suction mechanism 16 performs a suction cleaning, and the ejecting head 23 is filled up with a new solution. At this time, the solution, which is sucked by the suction mechanism 16 and is discharged from the ejecting head 23, is introduced to the liquid storage section 73 of the accommodation container 53 via the introduction passage 43.

In addition, in the liquid ejecting apparatus 11, while printing is performed or after the suction cleaning is completed, the carriage 21 is moved to above the flushing section 17 to perform a flushing in which the ejecting head 23 ejects the solution toward the circumferential surface 50 of the stopped rotational body 51. When the flushing is completed, the rotational body 51 is rotated and the scraper 70 scrapes off the solution attached onto the circumferential surface 50.

Herein, the drying apparatus 14 is arranged at a position which corresponds to the printing area. For this reason, water which is contained as the solvent evaporates, and thus the solution attached onto the rotational body 51 solidifies. However, the scraper 70 is biased by the bias member 75, and thus even the solidified solution can be scraped off.

In a case where the flushing is performed in the middle of printing, when the carriage 21 first undergoes a homeward movement toward the home position from the printing area in the −X movement direction, the solution is preferably ejected from the nozzle rows 25 that eject the solution which is unlikely to solidify. In addition, when the carriage 21 is moved toward the printing area from the home position in the +X movement direction subsequently to the homeward movement, the solution is preferably ejected from the nozzle rows 25 that eject the residual solution which is likely to solidify.

That is, the solution which is unlikely to solidify is first attached onto the circumferential surface 50. Accordingly, even when the solution attached thereonto solidifies, the solution is easily peeled off from the rotational body 51 by the scraper 70 that comes into sliding contact with the circumferential surface 50. It is possible to arbitrarily set the number of the nozzle rows 25 that first eject the solution on the circumferential surface 50.

The solution, which is scraped off by the scraper 70, falls into and is stored in the liquid storage section 73 together with the solution which is the unsolidified liquid discharged from the ejecting head 23. Herein, water is contained both in the solution ejected from the ejecting head 23 and in the solution which is the liquid stored in the liquid storage section 73. That is, the liquid storage section 73 stores the liquid which can dissolve the solute component of the solution. For this reason, the solute component of the solidified solution is redissolved in water which is contained as the solvent in the solution (liquid) discharged as the waste liquid.

When the liquid storage section 73 is full with the waste liquid that is introduced via the suction cleaning and the solution that is scraped off by the scraper 70, supernatant liquid of the solution stored in the liquid storage section 73 is overflowed to the discharge passage 45 via the liquid outlet 56. On the other hand, since solid substances, which are not dissolved in the liquid, stay in the liquid storage section 73, it is unlikely that the solid substances are deposited in the discharge passage 45 to cause a bad liquid flow or that the solid substances block the communication hole 47.

Since the flushing section 17 is arranged close to the drying apparatus 14, temperature in the vicinity of the accommodation container 53 is increased due to radiant heat that the heat generation section 32 radiates as illustrated by the one-dot chain line arrow in FIG. 2. Furthermore, since the air blowing section 33 blows air as illustrated by the dotted line arrow in FIG. 2, water contained in the solution is likely to evaporate.

On the other hand, the accommodation chamber 68 accommodates the rotational body 51 together with the scraper 70 and the liquid storage section 73 except for the upper surface side of the rotational body 51. In addition, the opening 72 of the accommodation container 53 is arranged in the gravity direction G below the rotational body 51 and a tip portion of the scraper 70 that is push-pressed to the circumferential surface 50 of the rotational body 51. For this reason, the interior of the accommodation chamber 68 is moisturized by water evaporated from the liquid storage section 73, and other portions are suppressed from drying except for the scraper 70 or the upper surface side of the rotational body 51. Accordingly, the solution is unlikely to solidify in the accommodation chamber 68. In addition, since the accommodation container 53 is refilled with a new waste liquid whenever the suction cleaning is performed, the concentration of the solute in the liquid storage section 73 is suppressed from being increased.

As described above, the liquid storage section 73 is configured in such a manner that the solidified substances of the solution are likely to be redissolved. However, when the solidified substances of the solution are deposited due to long-term usage or the like, it is possible to disassemble the retention frame 52 and the accommodation container 53 from the mounting section 54 for maintenance. For example, the cleaning of the rotational body 51 and the liquid storage section 73, the replacement of the accommodation container 53 or the like is cited as the maintenance of the flushing section 17. In addition, the scraper 70 may be disassembled from the retention section 74 of the accommodation container 53 to be cleaned or replaced.

Figure 3:
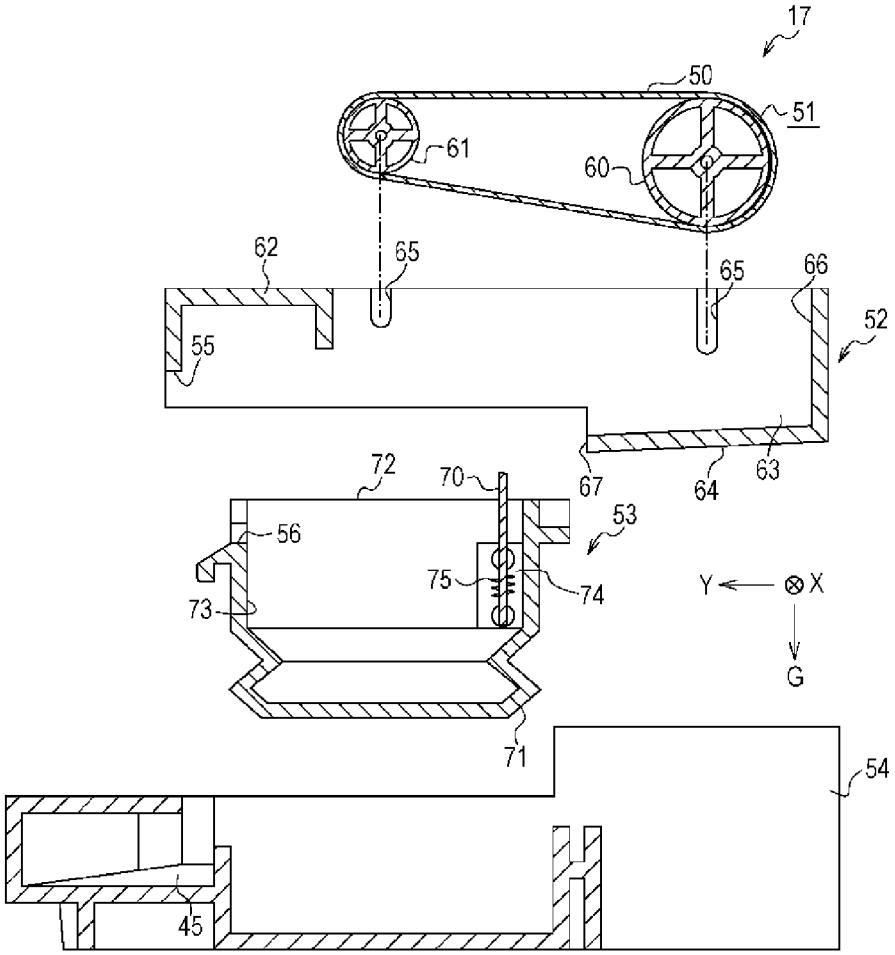
FIG. 3 illustrates a cross-sectional view of a flushing section that is disassembled into detachable configuration elements.

As illustrated in FIG. 3, when the accommodation container 53 is disassembled from the mounting section 54, the bellows-like shaped bottom portion 71 is extended and the volume of the liquid storage section 73 is increased. Since the level of the liquid in the liquid storage section 73 is lowered in this way, it is possible to disassemble the accommodation container 53 from the mounting section 54 without spilling the stored solution out of the liquid storage section 73.

In addition, when the accommodation container 53 is replaced, the rotational body 51 and the rollers 60 and 61 may be disassembled from the retention frame 52 in a state where the retention frame 52 and the accommodation container 53 are mounted on the mounting section 54.

When the heat generation section 32 and the air blowing section 33 are driven in this state, heated air is blown into the accommodation chamber 68 via the upper opening 66 of the retention frame 52, and thus water, which is contained in the solution in the liquid storage section 73, evaporates and the level of the solution is lowered. Accordingly, it is possible to disassemble the accommodation container 53 from the mounting section 54 without spilling the stored solution out of the liquid storage section 73.

According to the embodiment, the following effects can be obtained.

(1) The scraper 70 scrapes off the solution attached onto the circumferential surface 50 of the rotational body 51, and the scraped solution is accommodated in the accommodation container 53. When the solution which is scraped off by the scraper 70 solidifies, the solidified solute component can be redissolved in the liquid stored in the liquid storage section 73. Accordingly, the occurrence of deposits due to the solidification of the solution can be suppressed in the accommodation container 53.

(2) The solution stored in the liquid storage section 73 is drained to the waste liquid recovery passage 42 via the liquid outlet 56, and thus the service life of the accommodation container 53 can be extended.

(3) When the level of the liquid in the liquid storage section 73 reaches the liquid outlet 56, the solidified substances of the solution can be retained in the accommodation container 53 whereas the supernatant of the solution can be drained to the waste liquid recovery passage 42. For this reason, the solidified substances may be suppressed from being deposited in the waste liquid recovery passage 42.

(4) Since the solution sucked from the ejecting head 23 is introduced to the liquid storage section 73 via the introduction passage 43, the solidified solute component in the accommodation container 53 can be redissolved in the solution. Accordingly, a liquid for redissolving the solute component is not required to be separately provided.

(5) When the solidified substances of the solution are accumulated in the accommodation container 53, the accommodation container 53 can be disconnected from the mounting section 54 for maintenance such as cleaning or replacement. In addition, since the accommodation chamber 68, which is formed by the accommodation container 53 and the retention frame 52, has a high solvent concentration due to the solvent component evaporating from the liquid storage section 73, the solution which is scraped off by the scraper 70 can be suppressed from solidifying.

(6) Since the solution ejected from the ejecting head 23 contains water, the solute component of the solidified solution can be redissolved in the accommodation container 53 when the solution, which is scraped off by the scraper 70, is stored in the liquid storage section 73 together with the liquid containing water.

The embodiment may be modified as follows. In addition, the embodiment and the following modification example can be arbitrarily combined.

The following is arranged in the liquid storage section 73: portions other than the upper surface of the rotational body 51 that accommodates the solution and the scraper 70. In this configuration, while the solution, which is attached and solidifies onto the upper surface of the rotational body 51, can be redissolved in the liquid stored in the liquid storage section 73, the solution can be scraped off by the scraper 70. When the rotational body 51 is a columnar-shaped drum, the rotational body 51 is unlikely to be defectively rotated due to the adhesion of the solute component even though the rotational body 51 is submerged in the solution in the liquid storage section 73.

The shape of the scraper 70 is not limited to a plate shape, and, for example, the scraper 70 may be a belt-shaped member between which the rotational body 51 formed of a belt is interposed. In this configuration, even when a portion of the rotational body 51 formed of a belt is arranged in the liquid storage section 73, the solution can be suppressed from attaching onto an inner circumferential surface of the belt.

One or both of the rotational body 51 and the scraper 70 may be metallic member(s). In this configuration, water, which evaporates from the solution, is condensed on a surface of the metallic member exposed from the liquid storage section 73 in the moisturized accommodation chamber 68, and thus the solution can be suppressed from being adhered to the metallic member.

Any one or all of the rotational body 51, the retention frame 52, the accommodation container 53 and the scraper 70 may be configured not to be attached and detached.

The retention frame 52 and the accommodation container 53 may be formed in an integral manner.

The bottom portion 71 of the accommodation container 53 may be configured to be not expandable or contractible. In this configuration, maintenance such as the cleaning of the liquid storage section 73 can be easily performed.

The suction mechanism 16 may be configured not to be provided. In addition, the introduction passage 43 connected to the suction mechanism 16 may be configured not to be provided. In this case, for example, a passage is provided to introduce the liquid, which contains the solvent component such as water, to the liquid storage section 73, or the accommodation container 53 is mounted on the mounting section 54 in a state where the liquid such as water is put into the liquid storage section 73 in advance, and thus the liquid storage section 73 can store the liquid which can dissolve the solute component of the solution. When the liquid storage section 73 stores water which is free of the solute component, solubility of the solidified solute can be increased.

The drying apparatus 14 may be configured not to be provided.

A heating apparatus may be provided separately from the drying apparatus 14 to reduce the solution in the liquid storage section 73.

The scraper 70 may be configured to be retained by the retention frame 52. In this configuration, the waste liquid stored in the liquid storage section 73 can be suppressed from attaching onto the scraper 70.

The scraper 70 and the rotational body 51 may be arranged outside the accommodation chamber 68.

The retention section 74 may not include the bias member 75.

The liquid outlet 56 may be a notch which is open toward the opening 72 side, and the liquid outlet 56 may be a hole which is separated from the opening 72.

The liquid outlet 56 may not be provided in the accommodation container 53.

The liquid outlet 56 can be arranged in the liquid storage section 73. That is, the liquid storage section 73 may not store the liquid all the time. Even in this case, whenever the waste liquid is introduced to the liquid storage section 73 via the introduction passage 43, the solidified substances of the solution contained in the accommodation container 53 can be dissolved.

The liquid outlet 56 may be arranged in the bottom portion of the liquid storage section 73. In this case, a net or the like is provided to suppress the solid substances from being drained to the liquid outlet 56, and thus large solid substances can be suppressed from being drained. In this configuration, the solute component, which is settled on the bottom portion of the liquid storage section 73, can be drained through the liquid outlet 56.

Second Embodiment

Hereinafter, a second embodiment of an ink jet type printer that ejects an ink as an example of a liquid onto a sheet to print an image which contains a letter, a figure and the like, will be described as an example of the liquid ejecting apparatus with reference to the accompanying drawings.

Figure 4:
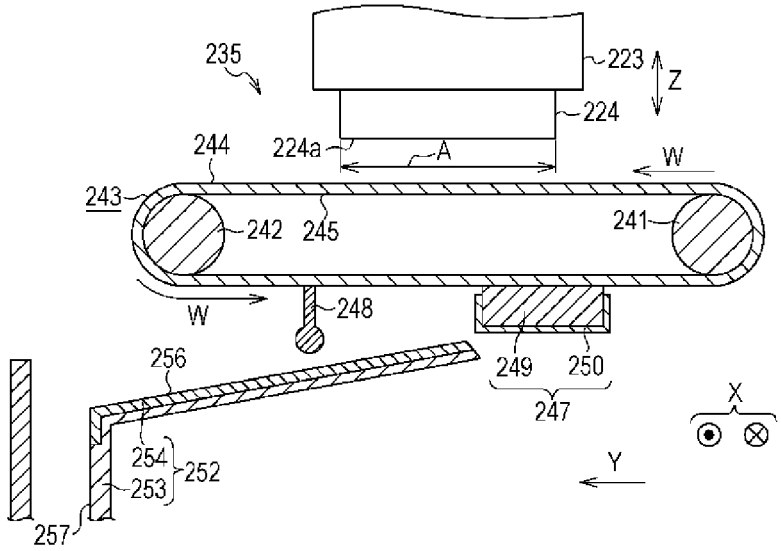
FIG. 4 is a schematic cross-sectional view of a flushing section according to a second embodiment.

As illustrated in FIG. 4, a flushing section 235 includes a drive roller 241 that is rotated in association with the drive of a flushing motor (not illustrated). The drive roller 241 is provided in such a manner that the drive roller 241 can be rotated about a shaft line extended along a scanning direction X. In addition, the flushing section 235 includes a driven roller 242 that is rotatable about a shaft line extended along the scanning direction X; a belt 243 that is an example of the liquid receiving section and is revolvably wound around the drive roller 241 and the driven roller 242. The belt 243 has the shape of a belt which has a width in the scanning direction X, and the belt 243 is formed in an endless shape to have an outer circumferential surface that can face a nozzle formation surface 224*a* and becomes a liquid receiving surface 244 which receives an ink ejected from a liquid ejecting head 224. On the other hand, the belt 243 has an inner circumferential surface 245 that is on a side opposite to the liquid receiving surface 244 and is supported by the drive roller 241 and the driven roller 242.

Furthermore, the flushing section 235 includes a moisturizing liquid supply section 247 and a liquid scraping section 248 which are arranged and fixed in a state where the moisturizing liquid supply section 247 and the liquid scraping section 248 are in contact with the liquid receiving surface 244 of the belt 243. The moisturizing liquid supply section 247 serves to supply a moisturizing liquid to the liquid receiving surface 244 of the belt 243. For example, the moisturizing liquid supply section 247 includes an absorption member 249 that is formed of a porous material capable of retaining the moisturizing liquid and is arranged to contact with the liquid receiving surface 244; and a supporting member 250 that supports the absorption member 249 in a state where the absorption member 249 retains the moisturizing liquid contained therein. On the other hand, the liquid scraping section 248 is provided over the width of the belt 243 in the scanning direction X, and the liquid scraping section 248 is moved relative to the belt 243 to scrape off the ink which is ejected from the liquid ejecting head 224 and is attached onto the liquid receiving surface 244.

The moisturizing liquid supply section 247 and the liquid scraping section 248 are provided in such a manner that a portion of the belt 243 that is moved along a revolving direction W and contacts with the moisturizing liquid supply section 247, passes through a liquid receiving area A that receives the ink ejected from the liquid ejecting head 224, and then the liquid scraping section 248. For this reason, the liquid ejecting head 224 ejects the ink onto a moisturizing area B (refer to FIG. 5) of the liquid receiving surface 244 in the belt 243, and the moisturizing liquid supply section 247 supplies the moisturizing liquid to the moisturizing area B. In addition, the moisturizing liquid supply section 247 and the liquid scraping section 248 are in sliding contact with the revolving belt 243. Accordingly, the flushing motor (not illustrated) that drives the belt 243 functions as an example of a movement mechanism that moves the moisturizing liquid supply section 247 and the liquid scraping section 248 relative to the belt 243.

In addition, a leading section 252 is provided over the width of the belt 243 in the scanning direction X at a lower position than the belt 243 in a vertical direction Z, and the leading section 252 leads the ink, which is scraped off from the belt 243 by the liquid scraping section 248, to a waste liquid tank (not illustrated). The leading section 252 is configured to have a base section 253 and an attachment/detachment section 254 that is detachable with respect to the base section 253. In addition, the leading section 252 has a first route section 256 in a slope and a second route section 257 of which the slope is almost vertical compared to the first route section 256. The attachment/detachment section 254 is formed to be extended from the first route section 256 to the middle of the second route section 257. That is, the attachment/detachment section 254 covers the first route section 256 in the base section 253 and a part in which the first route section 256 and the second route section 257 are connected with each other.

Figure 5:
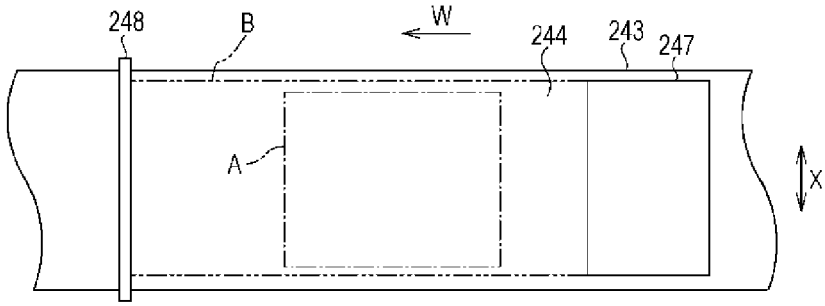
FIG. 5 is a top view of a belt illustrating a moisturizing area according to the second embodiment.

For the convenience of explanation for the liquid receiving area A and the moisturizing area B to which the moisturizing liquid supply section 247 supplies the moisturizing liquid, FIG. 5 illustrates a state where the annular-shaped belt 243 is cut between the moisturizing liquid supply section 247 and the liquid scraping section 248 and then the cut belt 243 is planarly spread out. As illustrated in FIG. 5, the moisturizing area B is an area from the moisturizing liquid supply section 247 to the liquid scraping section 248 in the revolving direction W, and the moisturizing area B is an area in which the moisturizing liquid supply section 247 is in sliding contact with the liquid receiving surface 244 in the scanning direction X and to which the moisturizing liquid is supplied. Furthermore, the liquid receiving area A is an area within the moisturizing area B and is an area in which the liquid receiving area A can face the liquid ejecting head 224 that is moved in the scanning direction X and to which the liquid ejecting head 224 ejects the ink.

Figure 6:
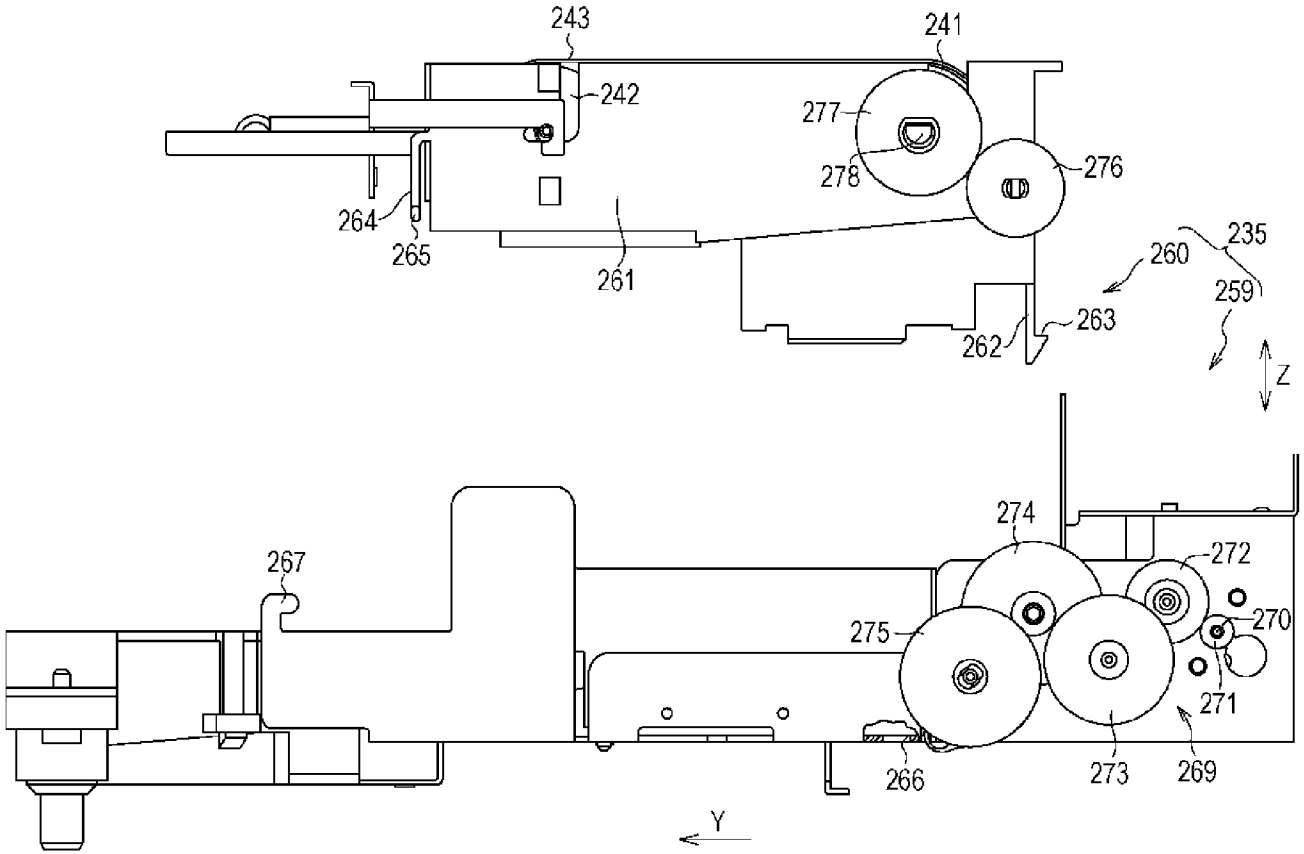
FIG. 6 is an exploded view illustrating a flushing box and a holder according to the second embodiment.

As illustrated in FIG. 6, the flushing section 235 has a flushing box 260 as an example of a liquid receiving apparatus detachably provided with respect to a holder 259 with which the printer 11 is equipped. The flushing box 260 includes a frame 261 that is attached and detached with respect to the holder 259, and the frame 261 supports: the drive roller 241 and the driven roller 242 around which the belt 243 is entrained; the moisturizing liquid supply section 247; the liquid scraping section 248; and the attachment/detachment section 254. That is, when the frame 261 is attached and detached from the holder 259, the moisturizing liquid supply section 247 is detachable with respect to the printer 11 integrally with the belt 243 and the liquid scraping section 248.

In addition, the flushing box 260 has a first arm portion 262 provided at a position which is on an upstream side in a transportation direction Y of a sheet ST when the flushing box 260 is mounted on the holder 259, and the first arm portion 262 protrudes downward in the vertical direction Z, and a first pawl portion 263 is provided at a tip of the first arm portion 262. In addition, the flushing box 260 has a second arm portion 264 provided at a position which is on a downstream side in the transportation direction Y of the sheet ST when the flushing box 260 is mounted on the holder 259, and the second arm portion 264 protrudes downward in the vertical direction Z, and a second pawl portion 265 is provided at a tip of the second arm portion 264. On the other hand, the holder 259 has a first engagement portion 266 that is engaged with the first pawl portion 263; and a second engagement portion 267 that is engaged with the second pawl portion 265.

Furthermore, a power transmission mechanism 269 is provided in the holder 259 and the flushing box 260. The power transmission mechanism 269 transmits power from the flushing motor (not illustrated) to the drive roller 241. That is, first on the holder 259 side, a first gear 271 is fitted onto a rotary shaft 270 of the flushing motor (not illustrated), and five of (at least one) the first gear 271 to a fifth gear 275 are provided to mesh with each other in ascending order of number. Furthermore, the flushing box 260 has a sixth gear 276 that can mesh with the fifth gear 275; and a seventh gear 277 that can mesh with the sixth gear 276. The seventh gear 277 is fitted onto a shaft 278 of the drive roller 241.

Figure 7:
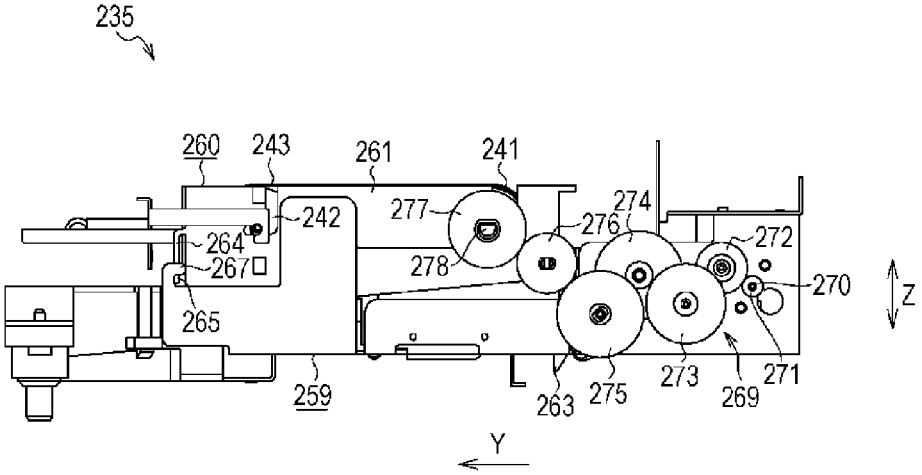
FIG. 7 is a side view illustrating a state where the flushing box is mounted on the holder according to the second embodiment.

For this reason, as illustrated in FIG. 7, when the flushing box 260 is mounted on the holder 259, the fifth gear 275 meshes with the sixth gear 276, and a driving force of the flushing motor (not illustrated) is transmitted to the drive roller 241 via the power transmission mechanism 269. When the apparatus is seen from the side as illustrated in FIG. 7, the first gear 271, a third gear 273, the fifth gear 275, the seventh gear 277 and the belt 243 are rotated in the counterclockwise direction, and a second gear 272, a fourth gear 274 and the sixth gear 276 are rotated in the clockwise direction.

Subsequently, the moisturizing liquid, which the moisturizing liquid supply section 247 supplies to the belt 243, will be described. The moisturizing liquid retained by the moisturizing liquid supply section 247 contains glycerin or alkyl polyols as a main raw material. That is, the moisturizing liquid contains 1.0 mass % or more of glycerin or alkyl polyols with respect to the total mass of the moisturizing liquid (100 mass %). Since the ink, which is attached and solidifies onto the belt 243, is likely to be peeled off from the belt 243 by a moisturizing liquid, the moisturizing liquid suppresses the ink attached onto the belt 243 from drying, differently from a cleaning agent (for example, surfactant such as a silicone oil) which is coated on the belt 243. That is, when the ink is ejected onto the liquid receiving surface 244 onto which the moisturizing liquid is attached, even ink with good drying properties is suppressed by the moisturizing liquid from drying.

Subsequently, an operation, in which the printer 11 performs printing on the sheet ST, will be described, particularly, focusing on an operation in which the liquid ejecting head 224 ejects the ink to perform a flushing.

When printing is started by a user, a carriage 223 is moved along the scanning direction X, and the liquid ejecting head 224 ejects the ink onto the sheet ST which is intermittently transported in the transportation direction Y so that the printing is performed. Furthermore, when a given time elapses from the previous flushing, the carriage 223 is moved to a home position HP and the liquid ejecting head 224 ejects the ink to the flushing section 235 to perform a flushing.

On the other hand, the belt 243 is revolved in association with the drive of the flushing motor (not illustrated) in the flushing section 235. The moisturizing liquid supply section 247 is moved relative to the belt 243, and the moisturizing liquid supply section 247 supplies the moisturizing liquid to coat the moisturizing area B of the liquid receiving surface 244 with the moisturizing liquid (moisturizing liquid supply step). For this reason, when the liquid ejecting head 224 ejects the ink toward the belt 243, the ink is received by the moisturizing area B of the liquid receiving surface 244 to which the moisturizing liquid is supplied (liquid receiving step). The ink attached onto the belt 243 is moved with the revolving belt in a state where the ink is suppressed by the moisturizing liquid from drying. For this reason, the liquid scraping section 248 is moved relative to the belt 243, and thus the ink, which is transformable before solidification or has fluidity, is scraped off from the belt 243 together with the moisturizing liquid (liquid scraping step). The ink and the moisturizing liquid, which are scraped off by the liquid scraping section 248, are discharged along the leading section 252 to the waste liquid tank which is not illustrated.

The phrase "that the ink attached onto the belt 243 is scraped off" indicates not only a state where the entire ink attached onto the belt 243 is removed but also a state where a portion of ink attached onto the belt 243 is removed. That is, the ink attached onto the belt 243 is not required to be entirely removed, and a portion of the ink may remain attached on the belt 243. In addition, the liquid scraping operation may be performed multiple times in order to remove the ink.

Subsequently, the operation, in which the flushing box 260 is mounted on the holder 259, will be described. As illustrated in FIG. 7, an initial state is a state where the flushing box 260 is mounted on the holder 259.

Figure 8:
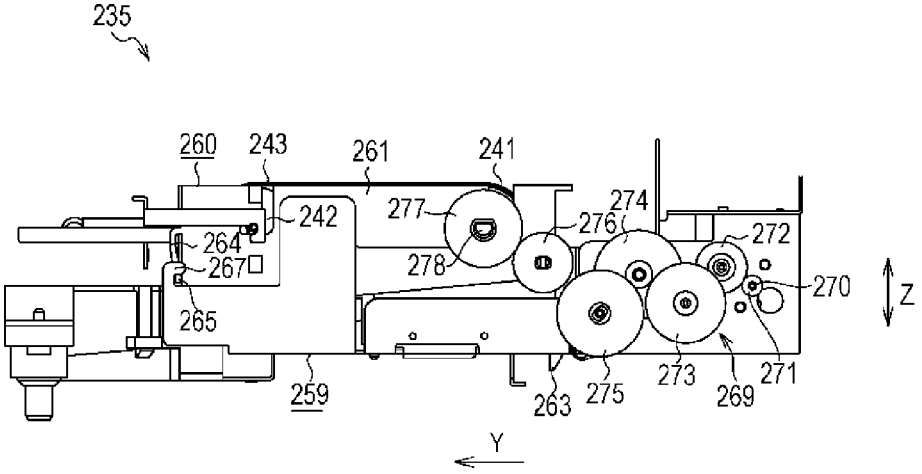
FIG. 8 is a side view when the flushing box is disassembled from the holder according to the second embodiment.

As illustrated in FIG. 8, first a user moves the flushing box 260 toward a direction (downstream side of the transportation direction Y in the embodiment) in which the first pawl portion 263 is disconnected from the first engagement portion 266. At this time, the second pawl portion 265 remains engaged with the second engagement portion 267 and the second arm portion 264 is bent.

Figure 9:
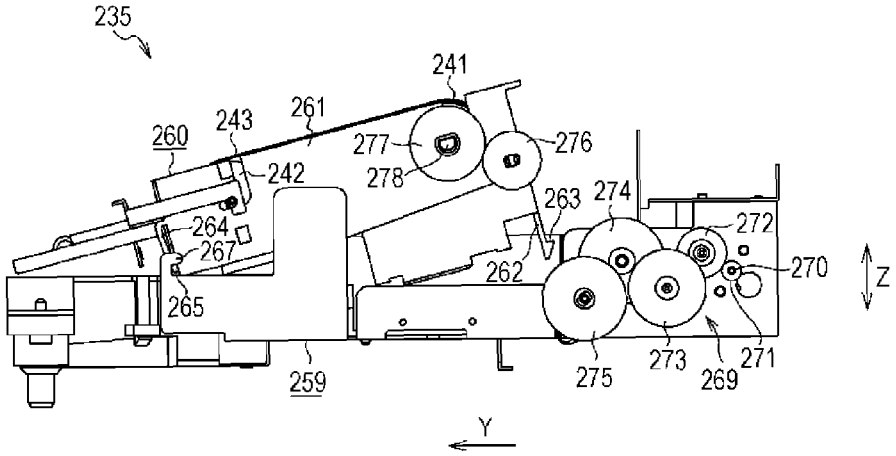
FIG. 9 is a side view when the flushing box is disassembled from the holder according to the second embodiment.
Figure 10:
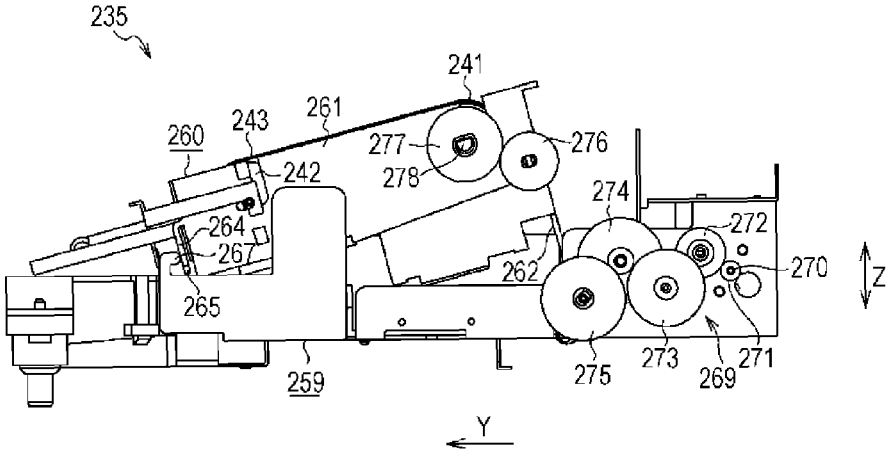
FIG. 10 is a side view when the flushing box is disassembled from the holder according to the second embodiment.

Subsequently, as illustrated in FIG. 9, the user lifts upward the first pawl portion 263 side of the flushing box 260 in the vertical direction Z, in which the first pawl portion 263 is disengaged from the first engagement portion 266. Furthermore, as illustrated in FIG. 10, the user slightly moves the flushing box 260 toward the first pawl portion 263 side (upstream side of the transportation direction Y in the embodiment), and thus the user disengages the second pawl portion 265 and the second engagement portion 267 from each other. The flushing box 260 is disengaged and disassembled from the holder 259.

On the other hand, the process of mounting the flushing box 260 is the inverse of the process of disassembling the flushing box 260.

That is, as illustrated in FIG. 10, the user brings the flushing box 260 near the holder 259 in a state where the flushing box 260 is tilted in such a manner that the second pawl portion 265 side is lowered. Furthermore, as illustrated in FIG. 9, the user engages the second pawl portion 265 with the second engagement portion 267 and pushes downward the first pawl portion 263 side in the vertical direction Z. As illustrated in FIG. 8, the first arm portion 262 and the second arm portion 264 are bent and the first pawl portion 263 is engaged with the first engagement portion 266, and thus the flushing box 260 is mounted on the holder 259.

According to the second embodiment, the following effects can be obtained.

(7) Since the liquid ejecting head 224 ejects the ink onto the moisturizing area B of the liquid receiving surface 244 to which the moisturizing liquid is supplied in the belt 243, the ink, which is attached onto the liquid receiving surface 244 of the belt 243, is scraped off by the liquid scraping section 248 in a state where the ink is suppressed by the moisturizing liquid from drying and solidifying. Accordingly, while the ink attached onto the belt 243 can be suppressed from solidifying on the belt 243, the ink can be scraped off from the belt 243.

(8) Since the moisturizing liquid supply section 247 is detachable with respect to the printer 11, the moisturizing liquid supply section 247 can be easily refilled with the moisturizing liquid and can be easily replaced. For this reason, the amount of the moisturizing liquid, which is required to be retained by the moisturizing liquid supply section 247, can be reduced, and thus the apparatus can be suppressed from being increased in size.

(9) Since a plurality of members are detachable in an integral manner, assemblability of the flushing box 260 can be improved compared to when each member is individually assembled. Furthermore, for example, since the moisturizing liquid supply section 247 can be refilled with the moisturizing liquid in a state where the respective members are disassembled in an integral manner, the apparatus can adopt such an arrangement that the moisturizing liquid supply section 247 is hidden behind other members, and it is possible to increase the degree of freedom of the respective members being arranged.

(10) Even when the ink is substantially free of glycerin and is likely to dry, the ink attached onto the liquid receiving surface 244 of the belt 243 is scraped off by the liquid scraping section 248 in a state where the ink is suppressed by glycerin-containing moisturizing liquid from drying and solidifying. Accordingly, while the ink attached onto the belt 243 can be suppressed from solidifying on the belt 243, the ink can be scraped off from the belt 243.

(11) Since the liquid scraping section 248 scrapes off the ink, which is attached onto the moisturizing area B, together with the moisturizing liquid, the ink can be suppressed from solidifying in the leading section 252.

(12) The ink flows along the leading section 252 and thus the ink is likely to be deposited at a part in which the direction of the route is changed. On the other hand, since the attachment/detachment section 254 configures the part in which the first route section 256 and the second route section 257 are connected with each other, it is possible to easily replace the part in which the ink is likely to be deposited.

(13) For example, when the cleaning agent is attached onto the nozzle formation surface **224*a*, it takes time and effort to wipe out the cleaning agent with the solvent. On the other hand, even when the moisturizing liquid supplied to the belt 243 is attached onto the nozzle formation surface 224*a*, the moisturizing liquid can be easily wiped out by a wiper 234**.

(14) Since the sixth gear 276 is rotated in the clockwise direction whereas the fifth gear 275 is rotated in the counterclockwise direction, the flushing box 260 receives a force in a direction in which the flushing box 260 is mounted on the holder 259. Accordingly, a possibility of the flushing box 260 being disconnected from the holder 259 can be reduced, and a force applied to the first pawl portion 263 can be reduced.

The embodiment may be modified as follows.

In the embodiment, the flushing box 260 may be undetachably provided in the printer 11. In addition, the moisturizing liquid supply section 247 may be undetachably provided in the printer 11.

In the embodiment, the belt 243 may be revolved in a direction opposite to the revolving direction W. That is, the belt 243 may be rotated in such a manner that the upper surface of the belt 243 is moved toward a direction opposite to the transportation direction Y. In this case, the moisturizing liquid supply section 247 and the liquid scraping section 248 are preferably arranged in the reverse order.

In the embodiment, as long as the moisturizing liquid supply section 247 can supply the moisturizing liquid to the liquid receiving surface 244 before reaching the liquid receiving area A, the moisturizing liquid supply section 247 can be arranged at any position. For example, the arrangement position is not limited to a position in which the moisturizing liquid supply section 247 is in contact with the belt 243 from the lower side, and the moisturizing liquid supply section 247 may be arranged to be in contact with the belt 243 from the upper side. When the moisturizing liquid supply section 247 is arranged at a position in which the moisturizing liquid supply section 247 does not interfere with other members, only moisturizing liquid supply section 247 may be detachably provided in the printer 11. In addition, similarly, as long as the liquid scraping section 248 can be in sliding contact with the liquid receiving surface 244, the liquid scraping section 248 can also be arranged at any position.

In the embodiment, as long as the moisturizing liquid supply section 247 can supply the moisturizing liquid to the liquid receiving surface 244 of the belt 243, the moisturizing liquid supply section 247 can take any shape. For example, the moisturizing liquid supply section is made to be a reservoir that stores the moisturizing liquid, and a portion of the belt, which is supported by three rollers, may be arranged to pass through the reservoir. In addition, the moisturizing liquid supply section may coat the belt 243 with the moisturizing liquid by use of a brush or a spatula and may drip, eject or spray the moisturizing liquid. As long as the moisturizing liquid supply section can supply the moisturizing liquid to the liquid receiving surface 244, the moisturizing liquid supply section may not be moved relative to the belt 243.

In the embodiment, the belt 243 may be arranged and fixed, and the moisturizing liquid supply section 247 and the liquid scraping section 248 may be moved relative to the belt 243. In addition, in this case, the liquid receiving section may be formed of an inflexible member such as a board or a bed. Furthermore, the liquid receiving section formed of an inflexible member may be moved relative to the moisturizing liquid supply section 247 and the liquid scraping section 248. In addition, all of the liquid receiving section, the moisturizing liquid supply section 247 and the liquid scraping section 248 may be movable.

In the embodiment, the liquid ejecting apparatus may be a liquid ejecting apparatus that ejects or discharges other liquids than the ink. The liquid ejecting apparatus discharges the liquid in a micro droplet form, and the micro droplet has a granular shape, a tear drop shape or a filar shape with a tail. In addition, the liquid herein is preferably a material which can be ejected from the liquid ejecting apparatus. For example, the substance is preferably in liquid phase; the substance may be a liquid-form body with a high or low viscosity, a sol or a water gel; or the substance may be a fluid-form body such as an inorganic solvent, an organic solvent, a solution, a liquid resin or a liquid metal (metallic melt). In addition, the substance may be not only in a state of the liquid but also in a state where particles of a functional material, which is formed of a solid body such as a pigment or a metallic particle, are dissolved, dispersed or mixed in the solvent. The ink described in the embodiment, a liquid crystal or the like is cited as a representative example of the liquid. Herein, the ink contains various liquid compositions such as a typical water-based ink, an oil-based ink, a gel ink, or a hot melt ink. For example, the followings are specific examples of the liquid ejecting apparatus: a liquid ejecting apparatus that ejects a liquid containing a material such as an electrode material or a color material in the form of dispersion or dissolution, which is used for manufacturing a liquid crystal display, an electronic luminescence (EL) display, a surface emitting display, a color filter and the like. In addition, the liquid ejecting apparatus may be a liquid ejecting apparatus that ejects a bioorganic substance which is used for manufacturing a biochip; a liquid ejecting apparatus that ejects a specimen liquid and that is used as a precise pipette; a textile printing apparatus; or a micro dispenser. Furthermore, the liquid ejecting apparatus may be a liquid ejecting apparatus that ejects a lubricant oil at pinpoints in a precision machine such as a watch, a camera or the like; or a liquid ejecting apparatus that ejects a transparent resin liquid such as an ultraviolet curable resin on a substrate to form a micro hemisphere lens (optical lens) used on an optical communication element or the like. In addition, the liquid ejecting apparatus may be a liquid ejecting apparatus that ejects an etchant such as an acid or an alkali to etch a substrate.

The ejecting head 23 may be configured to eject a liquid which does not contain water.

In the embodiment, the liquid ejecting apparatus may be a liquid ejecting apparatus that ejects or discharges other liquids than an ink. The liquid ejecting apparatus discharges the liquid in a micro droplet form, and the micro droplet has a granular shape, a tear drop shape or a filar shape with a tail. In addition, the liquid herein is preferably a material which can be ejected from the liquid ejecting apparatus. For example, the substance is preferably in liquid phase; the substance may be a liquid-form body with a high or low viscosity, a sol or a water gel; or the substance may be a fluid-form body such as an inorganic solvent, an organic solvent, a solution, a liquid resin or a liquid metal (metallic melt). In addition, the substance may be not only in a state of the liquid but also in a state where particles of a functional material, which is formed of a solid body such as a pigment or a metallic particle, are dissolved, dispersed or mixed in the solvent. The ink described in the embodiment, a liquid crystal or the like is cited as a representative example of the liquid. Herein, the ink contains various liquid compositions such as a typical water-based ink, an oil-based ink, a gel ink, or a hot melt ink. For example, the followings are specific examples of the liquid ejecting apparatus: a liquid ejecting apparatus that ejects a liquid containing a material such as an electrode material or a color material in the form of dispersion or dissolution, which is used for manufacturing a liquid crystal display, an electronic luminescence (EL) display, a surface emitting display, a color filter and the like. In addition, the liquid ejecting apparatus may be a liquid ejecting apparatus that ejects a bioorganic substance which is used for manufacturing a biochip; a liquid ejecting apparatus that ejects a specimen liquid and that is used as a precise pipette; a textile printing apparatus; or a micro dispenser. Furthermore, the liquid ejecting apparatus may be a liquid ejecting apparatus that ejects a lubricant oil at pinpoints in a precision machine such as a watch, a camera or the like; or a liquid ejecting apparatus that ejects a transparent resin liquid such as an ultraviolet curable resin on a substrate to form a micro hemisphere lens (optical lens) used on an optical communication element or the like. In addition, the liquid ejecting apparatus may be a liquid ejecting apparatus that ejects an etchant such as an acid or an alkali to etch a substrate.

Cross References to Related Applications

The entire disclosure of Japanese Patent Application No. 2012-284497, filed Dec. 27, 2012 and Japanese Patent Application No. 2013-041913, filed Mar. 4, 2013 are expressly incorporated by reference herein.

What is claimed is:

1. A liquid ejecting apparatus comprising:

an ejecting head that can eject a solution;

a rotational body that has a circumferential surface which can accommodate the solution ejected from the ejecting head;

a scraper that can come into sliding contact with the circumferential surface of the rotational body;

an accommodation container that accommodates the solution which is scraped off from the circumferential surface by the scraper; and a waste liquid recovery passage that recovers a waste liquid, wherein the accommodation container has a liquid storage section that stores a liquid which can dissolve a solute component of the solution, wherein the accommodation container has a liquid outlet at a position which is located above the waste liquid recovery passage in a direction of gravity.

2. The liquid ejecting apparatus according to claim 1, wherein the accommodation container has an opening which is open at a position below a tip of the scraper in a direction of gravity, and wherein the liquid outlet of the accommodation container is arranged between the opening and the liquid storage section in a direction of gravity.

3. The liquid ejecting apparatus according to claim 1, further comprising:

a suction mechanism that sucks the solution from the ejecting head; and an introduction passage that introduces the solution, which is sucked by the suction mechanism, into the liquid storage section.

4. The liquid ejecting apparatus according to claim 1, further comprising:

a retention frame that rotatably retains the rotational body; and a mounting section on which the accommodation container and the retention frame are detachably mounted, wherein the accommodation container has a retention section that retains the scraper, and wherein the accommodation container and the retention frame form an accommodation chamber to surround the scraper when mounted on the mounting section.

5. The liquid ejecting apparatus according to claim 1, wherein the solution ejected from the ejecting head and the liquid stored in the liquid storage section contain water.

* * * * *